US007377310B2

(12) United States Patent
Benzie et al.

(10) Patent No.: US 7,377,310 B2
(45) Date of Patent: May 27, 2008

(54) SYSTEM FOR EXPANDING A TUBULAR ELEMENT IN A WELLBORE

(75) Inventors: Scott Anthony Benzie, Rijswijk (NL); Andrei Gregory Filippov, Katy, TX (US); Neil Philip Thomson, Rijswijk (NL)

(73) Assignee: Shell Oil Company, Houston, TX (US)

( * ) Notice: Subject to any disclaimer, the term of this patent is extended or adjusted under 35 U.S.C. 154(b) by 248 days.

(21) Appl. No.: 10/553,368

(22) PCT Filed: Apr. 13, 2004

(86) PCT No.: PCT/EP2004/050510

§ 371 (c)(1),
(2), (4) Date: Oct. 13, 2005

(87) PCT Pub. No.: WO2004/092536

PCT Pub. Date: Oct. 28, 2004

(65) Prior Publication Data

US 2006/0196654 A1 Sep. 7, 2006

(30) Foreign Application Priority Data

Apr. 17, 2003 (EP) ..... 03252486

(51) Int. Cl.
*E21B 43/10* (2006.01)

(52) U.S. Cl. ..... 166/72; 166/384; 166/387; 166/207

(58) Field of Classification Search ..... 166/384, 166/380, 207, 253.1, 255.2, 382, 206, 72, 166/216, 177.1, 177.2, 387
See application file for complete search history.

(56) References Cited

U.S. PATENT DOCUMENTS

| | | | | |
|---|---|---|---|---|
| 6,172,614 | B1 | 1/2001 | Robison et al. | 340/853.3 |
| 6,318,457 | B1 | 11/2001 | Den Boer et al. | 166/66.7 |
| 6,343,649 | B1 | 2/2002 | Beck et al. | 166/250.01 |
| 6,789,621 | B2 * | 9/2004 | Wetzel et al. | 166/253.1 |
| 6,799,637 | B2 * | 10/2004 | Schetky et al. | 166/384 |
| 2001/0045284 | A1 | 11/2001 | Simpson et al. | 166/313 |
| 2004/0065446 | A1 * | 4/2004 | Tran et al. | 166/384 |
| 2006/0272826 | A1 * | 12/2006 | Shuster et al. | 166/380 |

FOREIGN PATENT DOCUMENTS

| | | |
|---|---|---|
| WO | 92/06278 | 4/1992 |
| WO | 96/24752 | 8/1996 |
| WO | 02/057805 | 7/2002 |
| WO | 03/015954 | 2/2003 |

* cited by examiner

*Primary Examiner*—Kenneth Thompson

(57) ABSTRACT

A system is provided for expanding a tubular element extending into a wellbore formed in an earth formation. The system includes an expander arranged to expand the tubular element by virtue of axial movement of the expander through the tubular element, an activating system for inducing the expander to move through the tubular element, the activating system including at least one activating tool, and a control system for controlling the activating system, including a remote control unit and for each activating tool a respective controller. The remote control unit is arranged to transmit an acoustic signal to an acoustic conductor selected from the tubular element and another elongate member extending into the borehole, each controller being arranged to receive the acoustic signal from the acoustic conductor and to control the corresponding activating tool upon receipt of the acoustic signal.

16 Claims, 3 Drawing Sheets

SYSTEM FOR EXPANDING A TUBULAR ELEMENT IN A WELLBORE

CROSS REFERENCE TO RELATED APPLICATIONS

The present application claims priority on European Patent Application 03252486.0 filed Apr. 17, 2003.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC

Not applicable.

1. Field of the Invention

The invention relates to a system for expanding a tubular element extending into a wellbore formed in an earth formation.

2. Background of the Invention

Conventional wellbore tubulars, such as wellbore casings, have stepwise decreasing diameters with wellbore depth. This is because each lower tubular has to be lowered through previously installed upper tubulars, and therefore necessarily has to be of smaller diameter than the upper tubulars.

It has been tried to expand a lower wellbore casing in various ways, whereby it is a common concept to pull or pump an expander (also referred to as mandrel) through the lower casing. A problem in such procedure is that it is difficult to control the downhole activating system from surface, as such activating system generally includes various activating tools provided with components such as valves or motors, which are to be operated in a specific sequence.

SUMMARY OF THE INVENTION

In accordance with the one embodiment of invention there is provided a system for expanding a tubular element extending into a wellbore formed in an earth formation, the system comprising:

- an expander arranged to expand the tubular element by virtue of axial movement of the expander through the tubular element;
- an activating system for inducing the expander to move through the tubular element, the activating system including at least one activating tool; and
- a control system for controlling the activating system, including a remote control unit and for each activating tool a respective controller, the remote control unit being arranged to transmit an acoustic signal to an acoustic conductor selected from said tubular element and another elongate member extending into the borehole, each controller being arranged to receive said acoustic signal from the acoustic conductor and to control the corresponding activating tool upon receipt of said acoustic signal.

By transmitting a specific acoustic signal through the tubular element, or through the other elongate member, a specific controller only reacts to the specific signal, while the other controllers react to different specific signals. Thus, the activating tools may be operated in a selected sequence by inducing the specific acoustic signals in a corresponding sequence into the tubular or elongate member.

Suitably said another elongate member is a body of fluid contained in the tubular element.

Preferably each controller is provided with a respective energy source arranged to activate the corresponding activating tool upon receipt of said acoustic signal by the controller. For example, such energy source may be one of a hydraulic energy source, an electrical energy source and a mechanical energy source.

BRIEF DESCRIPTION OF THE DRAWINGS

The embodiments of the invention will be described hereinafter in more detail and by way of example, with reference to the accompanying drawings in which.

DETAILED DESCRIPTION OF THE INVENTION

Figure 1:
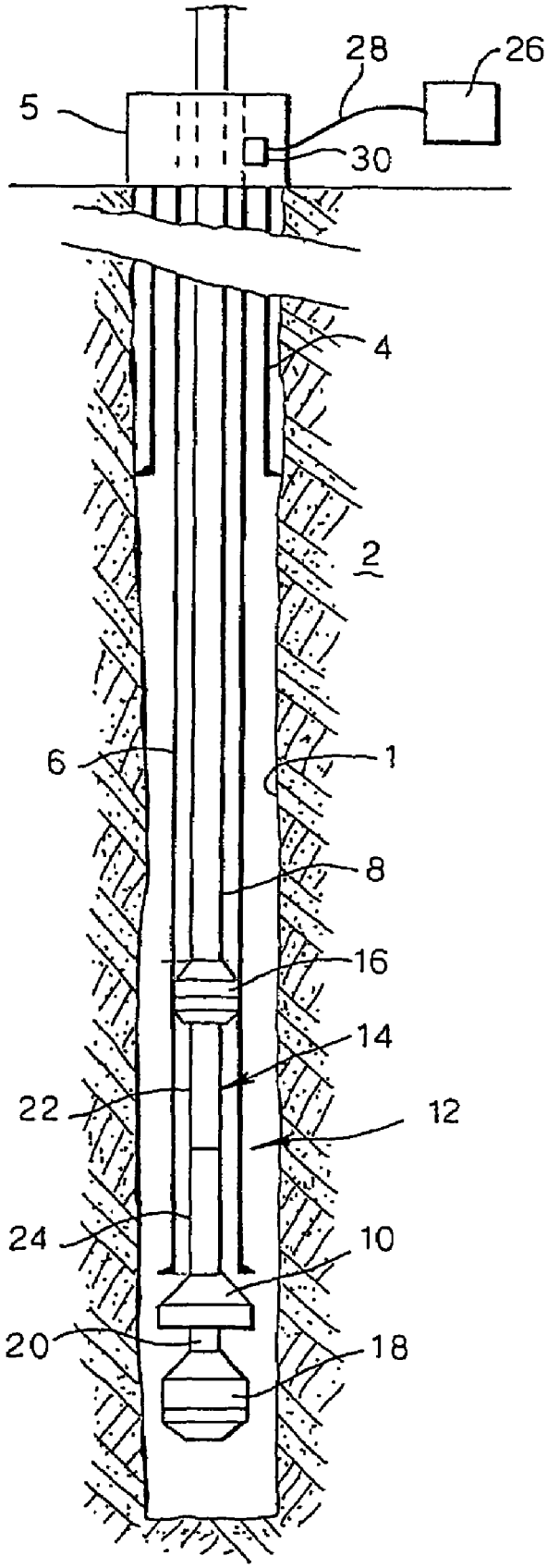
FIG. 1 schematically shows an embodiment of a system for expanding a casing in a wellbore.

In the Figures like reference numerals relate to like components.

Referring to FIG. 1 there is shown a wellbore 1 formed into an earth formation 2, the wellbore 1 being provided with a upper casing 4 extending from a wellhead 5 at surface, and a lower casing 6 extending from the wellhead 5, through the upper casing 4, to a depth near the bottom of the wellbore 1. A running string 8 extends from a drilling rig (not shown) at surface through the lower casing 6, and is connected to an expander 10 for radially expanding the lower casing 6. The expander 10 is arranged just below the lower end of the lower casing 6. The running string 8 is provided with a fluid channel which is in communication with a through-bore provided in the expander 10, for pumping hydraulic fluid to the space below the expander 10.

An activating system 12 is provided for pulling and pumping the expander 10 through the lower casing 6 in order to expand same. The activating system 12 includes three activating tools, i.e. a hydraulic pulling tool 14 (referred to hereinafter as a "force multiplier"), an expandable anchor 16 for anchoring the upper end of the force multiplier 14 to the interior surface of the lower casing 6, and an expandable packer 18 for sealing the interior of the lower casing 5. The packer 18 is connected to the expander 10 by a releasable connector 20. The force multiplier 14 includes two telescoping members 22, 24 which are operable to move axially inwardly relative to each other upon supply of hydraulic power to the force multiplier through the running string 8.

A control system is provided for controlling the force multiplier 14, the expandable anchor 16 and the expandable packer 18. The control system includes a remote control unit 26 arranged at surface, and for each activating tool 14, 16, 18 a respective controller (not shown) arranged at the activating tool to which the respective controller pertains. The remote control unit 26 is connected by control line 28 to an acoustic transmitter 30 for the transmission of acoustic signals into the lower casing 6. Each controller includes an acoustic receiver arranged to allow the controller to receive the acoustic signals from the lower casing 6. Furthermore, each controller is provided with a respective energy source which is arranged to activate the corresponding activating tool upon receipt of an acoustic signal by the controller. Such energy source can be a hydraulic energy source, an electrical energy source or a mechanical energy source. The energy sources are set up to activate the respective activating tools at mutually different acoustic signals. For example, the acoustic signals can be different in frequency or volume.

A suitable control system with an acoustic transmitter and acoustic receiver which can be used in application of the invention, is disclosed in WO 92/06278 which is herein incorporated by reference.

Figure 2:
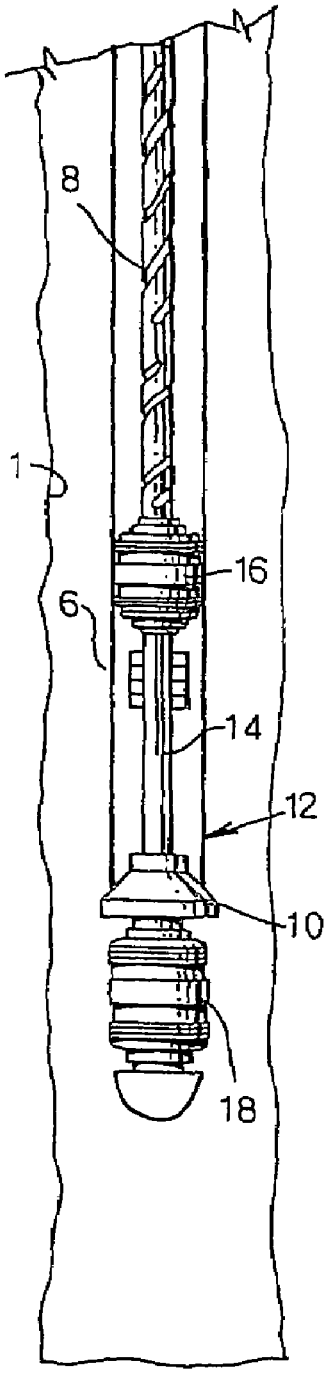
FIGS. 2-7 schematically show details of the embodiment of FIG. 1 at various stages of the expansion process, as described in more detail below.

In FIG. 2 is shown the lower part of the lower casing 6 prior to expansion thereof, whereby the expandable anchor 16 has been expanded against the inner surface of the casing 6 so as to anchor the upper end of the force multiplier 14 to the casing 6.

Figure 3:
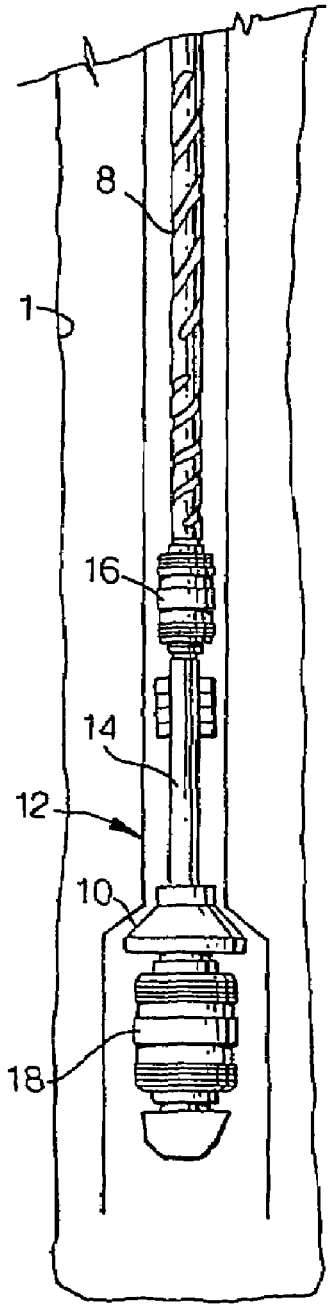

In FIG. 3 is shown the activating system 12 after the expander 10 has been pulled a short distance into the lower part of the lower casing 6 by the force multiplier 14.

Figure 4:
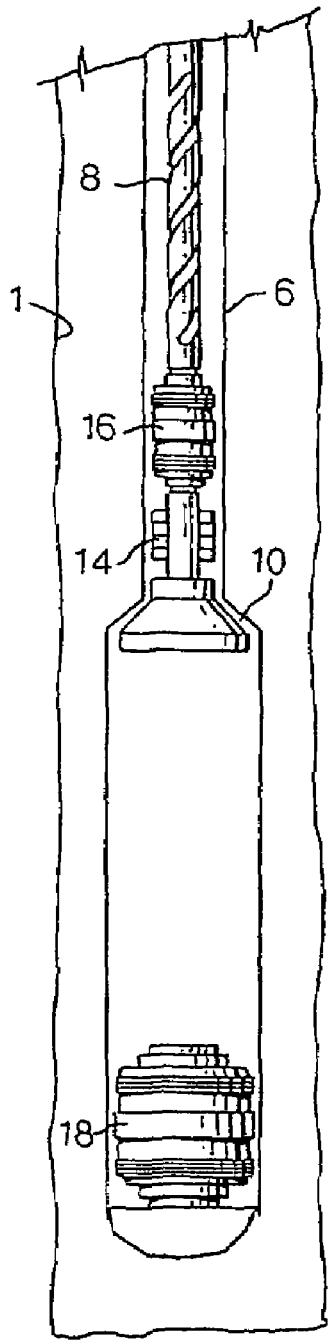

In FIG. 4 is shown the activating system 12 during further expansion of the lower casing 6 by pumping fluid below the expander 10.

Figure 5:
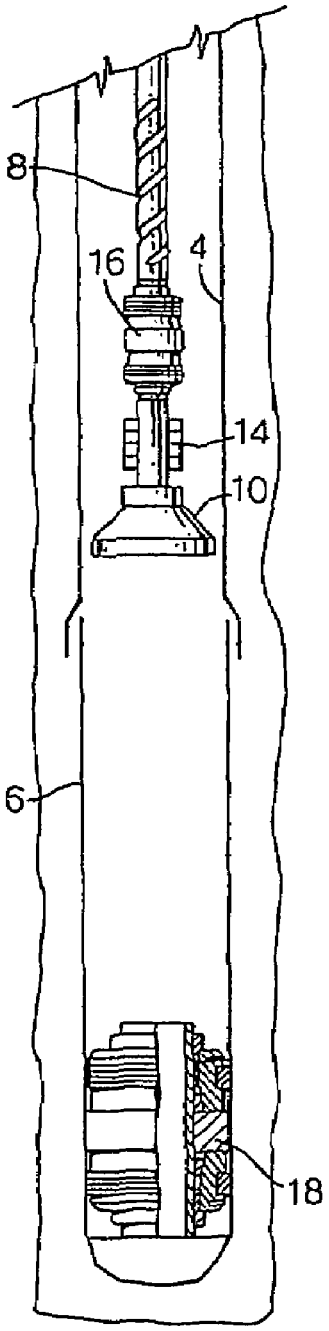

In FIG. 5 is shown the activating system 12 after expansion of the overlapping portions of the first and lower casings 4, 6.

Figure 6:
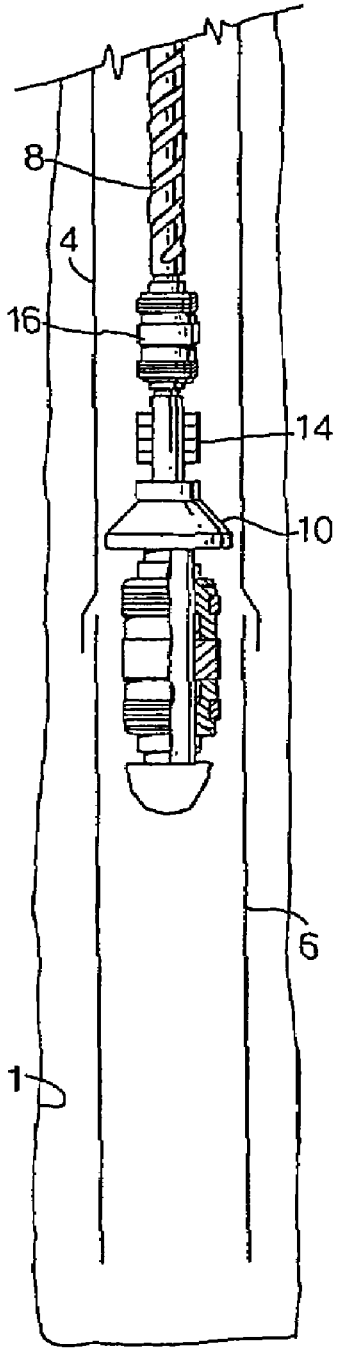

In FIG. 6 is shown the activating system 12 after reconnection of the expandable packer 18 to the expander 10.

Figure 7:
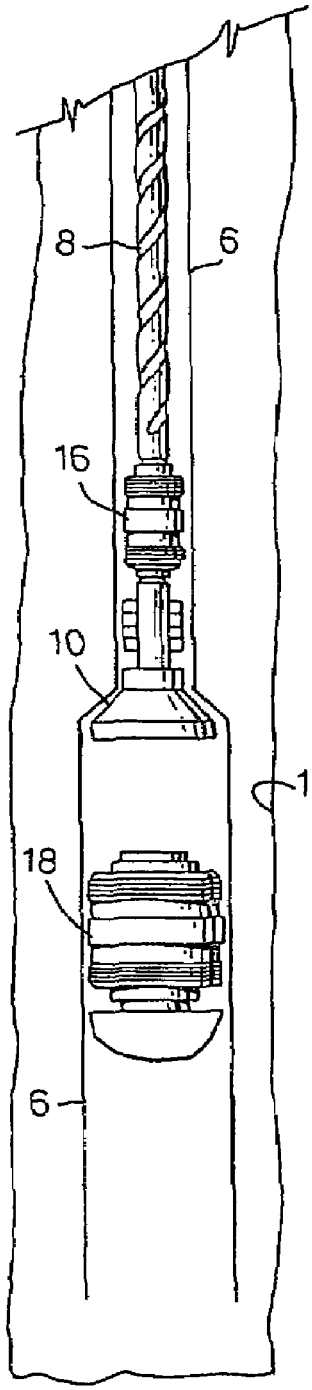

In FIG. 7 is shown the activating system 12 during a contingency operation.

During normal use the upper casing 4 is installed and cemented in the wellbore, whereafter the wellbore 1 is further drilled and the lower casing 6 is lowered into the wellbore 1. The lower casing is run into the wellbore 1 simultaneously with the running string 8 which suspends the hydraulic pulling tool 14, the force multiplier 14 and the expandable packer 18. Optionally the casing 6 is suspended by the expander 10, the force multiplier 14 and the running string 8 during lowering.

The remote control unit 26 is then operated to induce a first acoustic signal into the lower casing 6 by means of the transmitter 30. The first acoustic signal is selected such that the energy source of the expandable anchor 16 is reactive to the signal. The signal is picked up by the controller of the expandable anchor 16, by means of its acoustic receiver, and as a result the expandable anchor 16 expands itself against the casing 6 whereby the upper end of the force multiplier becomes anchored to the casing 6 as shown in FIG. 2.

In a next step the remote control unit 26 is operated to induce a second acoustic signal into the lower casing 6 by means of the transmitter 30, which second acoustic signal is such that the force multiplier 14 becomes activated by its respective energy source. The force multiplier 14 thereby pulls the expander 10 (with the packer 18 connected thereto) a short distance into the lower part of the lower casing 6 and thereby expands said lower part, as shown in FIG. 3.

Then the remote control unit 26 is operated to induce a third acoustic signal into the lower casing 6 by means of the transmitter 30. The third acoustic signal is such that the energy source of the expandable anchor 16 induces the expandable anchor 16 to retract from the inner surface of the casing 6.

A fourth acoustic signal is then induced into the lower casing 6 in order that the energy source of the expandable packer 18 induces the packer 18 to expand against the inner surface of the expanded portion of the lower casing 6 thereby sealing the lower casing 6, and to unlatch the packer 18 from the expander 10 by disconnecting the connector 20. Thereafter hydraulic fluid is pumped via the running string 8 and the through-bore of the expander 10, into the space between the expander 10 and the packer 18. This pumping action induces the expander 10 to move upwardly through the lower casing 6 and thereby to expand same, as shown in FIG. 4.

When the expander 10 arrives at the overlapping sections of the upper casing 4 and the lower casing 6, these overlapping sections are simultaneously expanded, as shown in FIG. 5. It will be understood that the force required to move the expander 10 through the overlapping sections is higher than before. In view thereof it may be advantageous if the overlapping section of the upper casing 4 is of reduced strength.

In a further step the expander 10 is lowered through the second casing 6 on the running string 8 until the expander 10 latches again to the packer 18 by means of connector 20. In this respect it is to be noted that the inner diameter of the expanded casing 6 is naturally slightly larger than the outer diameter of the expander 10, so that lowering of the expander 10 should be without obstruction. Then the activating system 12 is retrieved to surface by means of the running string 8, as shown in FIG. 6.

Should the lower casing 6 be damaged, pumping of the expander 10 through the lower casing 6 may not always be possible with the packer 18 arranged at the lower end of casing 6. This is because the damaged section may not be capable of withstanding the high internal fluid pressure. In such instances the packer 18 can be set at a distance from the lower end of the lower casing 6, i.e. above the damaged section of casing 6. This situation is shown in FIG. 7.

We claim:

1. A system for expanding a tubular element extending into a wellbore formed in an earth formation, the system comprising:

an expander arranged to expand the tubular element by virtue of axial movement of the expander though the tubular element;

an activating system for inducing the expander to move through the tubular element, the activating system including a plurality of activating tools, wherein the activating system further comprises a control system for controlling the activating system, including a remote control unit and for each activating tool a respective controller, the remote control unit being arranged to transmit an acoustic signal to an acoustic conductor selected from said tubular element and another elongate member extending into the borehole, each controller being arranged to receive said acoustic signal from the acoustic conductor and to control the corresponding activating tool upon receipt of said acoustic signal, wherein each controller is provided with a respective energy source, the energy sources being set up to activate the respective activating tools at mutually different frequencies or volumes of the acoustic signal.

2. The system of claim 1, wherein the tubular element is a wellbore casing.

3. The system of claim 1, wherein said another elongate member is a body of fluid contained in the tubular element.

4. The system of claim 1, wherein each controller is provided with a respective energy source arranged to activate the corresponding activating tool upon receipt of said acoustic signal by the controller.

5. The system of claim 4, wherein the energy source is one of a hydraulic energy source, an electrical energy source and a mechanical energy source.

6. The system of any one of claims 1-5, wherein a first said activating tool is a hydraulic pulling tool for pulling the expander through the tubular element.

7. The system of claim 6, wherein a second said activating tool is an expandable anchor arranged to anchor the pulling tool to the interior surface of the tubular element upon expansion of the anchor.

8. The system of claim 1, wherein a third said activating tool is an expandable packer for sealing an end portion of the tubular element, said packer being releasably connected to the expander.

9. The system of claim 8, wherein the expander and said packer are provided with a latching mechanism for latching the packer to the expander.

10. A system for expanding a tubular element extending into a wellbore formed in an earth formation, the system comprising:

an expander arranged to expand the tubular element by virtue of axial movement of the expander through the tubular element; and an activating system for inducing the expander to move through the tubular element, the activating system including a plurality of activating tools, said activating tools including:

a hydraulic pulling tool for pulling the expander through the tubular element, an expandable anchor arranged to anchor the pulling tool to the interior surface of the tubular element upon expansion of the anchor, and an expandable packer for sealing a portion of the tubular element;

wherein the activating system further comprises a control system for controlling the activating system, including a remote control unit and for each activating tool a respective controller, the remote control unit being arranged to transmit an acoustic signal to an acoustic conductor selected from said tubular element and another elongate member extending into the borehole, each controller being arranged to receive said acoustic signal from the acoustic conductor and to control the corresponding activating tool upon receipt of said acoustic signal, wherein each controller is provided with a respective energy source, the energy sources being set up to activate the respective activating tools at mutually different frequencies or volumes of the acoustic signal.

11. The system of claim 10 wherein the anchor is above the expander.

12. The system of claim 10 wherein the packer is below the expander.

13. The system of claim 10 wherein each controller is provided with a respective energy source arranged to activate the corresponding activating tool upon receipt of said acoustic signal by the controller.

14. The system of claim 11 wherein the energy source is one of a hydraulic energy source, an electrical energy source and a mechanical energy source.

15. The system of claim 10 wherein the expander and said packer are provided with a latching mechanism for latching the packer to the expander.

16. A method for expanding an unexpanded tubular using the system of claim 10, comprising the steps of:

a) positioning the system of claim 10 in the unexpanded tubular;

b) actuating the anchor so as to cause it to expand against the inner surface of the tubular;

c) actuating the pulling tool so as to cause it to advance a first distance though the tubular, thereby expanding a portion of the tubular;

d) actuating the packer so as to cause it to expand and seal a portion of the tubular;

e) pumping a fluid into the space between the expander and the packer so as to cause the expander to move through the tubular, thereby expanding the tubular.

* * * * *